US006120028A

United States Patent [19]

Boyer

[11] Patent Number: 6,120,028

[45] **Date of Patent: *Sep. 19, 2000**

[54] BOARD GAME FOR CRITICAL THINKING, CHARACTER AND VALUE DEVELOPMENT

[76] Inventor: Deborah Boyer, 3412 Marcus Ave., Newport Beach, Calif. 92663

[ * ] Notice: This patent issued on a continued prosecution application filed under 37 CFR 1.53(d), and is subject to the twenty year patent term provisions of 35 U.S.C. 154(a)(2).

[21] Appl. No.: 08/796,975

[22] Filed: Feb. 7, 1997

[51] Int. Cl.[7] ..... A63F 3/00; A63F 9/18

[52] U.S. Cl. ..... 273/243; 273/431; 273/432

[58] Field of Search ..... 273/243, 249, 273/237, 250–254, 429–432, 146

[56] References Cited

U.S. PATENT DOCUMENTS

| | | | |
|---|---|---|---|
| 1,257,779 | 2/1918 | Anderson | 273/146 |
| 3,815,919 | 6/1974 | Cain et al. | 273/249 |
| 4,216,594 | 8/1980 | Farley et al. | 273/249 |
| 4,807,878 | 2/1989 | Tripp | 273/237 |
| 4,846,479 | 7/1989 | Hanley | 273/236 |
| 5,002,282 | 3/1991 | Hanley | 273/236 |
| 5,257,939 | 11/1993 | Robinson et al. | 434/129 |
| 5,377,990 | 1/1995 | Seeney-Sullivan | 273/236 |
| 5,480,337 | 1/1996 | Baker | 446/100 |
| 5,549,301 | 8/1996 | Gerrard | 273/305 |
| 5,551,700 | 9/1996 | Druce et al. | 273/296 |

FOREIGN PATENT DOCUMENTS

| | | | |
|---|---|---|---|
| 2738798 | 3/1979 | Germany | 273/249 |

*Primary Examiner*—Benjamin H. Layno
*Attorney, Agent, or Firm*—Blakely, Sokoloff, Taylor & Zafman

[57] ABSTRACT

The present invention is a method and apparatus for an interactive game that provides critical thinking, character and value development. The game for a plurality of participants comprises a playing surface having a plurality of playing regions. Each of the plurality of playing regions represents a different value category. The game also comprises a plurality of decks of playing cards. One side of each playing card in each deck displays a topic corresponding to a respective one of the value categories. The game further comprises a plurality of gamepieces, each assigned to one of the plurality of participants. Each of the gamepieces marks a playing position of the corresponding participant on the playing surface. In one embodiment, each surface of the dice has a color corresponding to the color of one of the decks of cards. During play, the selection of the deck from which a card is drawn is determined by the color of the surface of the dice that is cast. The participant then has a predetermined length of time to discuss or analyze the topic provided on the card. Value and character development of participants may be enhanced through the participation and guidance of a coordinator, parent or educator.

26 Claims, 5 Drawing Sheets

50

Location: Home

Your parents work very hard. They don't have extra money to buy you nice clothes. you feel guilty and embarrassed because some kids in school are teasing you. You know that your family can't afford new clothes for you...what can you do or say?

60

BOARD GAME FOR CRITICAL THINKING, CHARACTER AND VALUE DEVELOPMENT

BACKGROUND OF THE INVENTION

1. Field of the Invention

The present invention relates to games, and more particularly to an apparatus and method for an interactive game which provides critical thinking, character and value development.

2. Description of the Related Art

In recent years, a number of books and articles which address character development in children have been published. These publications typically provide guidelines to parents or educators on the discipline and character development of children. Although games have also been developed to provide educational instruction and/or entertainment value, there is a lack of a game which provides a tool for teaching life skills and for developing the participant's critical thinking, character and values. In particular, there is a lack of an interactive game that guides children or adolescents through real life scenarios in which they can make their own value-based decisions and learn to solve their own social problems.

BRIEF SUMMARY OF THE INVENTION

The present invention is a method and apparatus for an interactive game that provides critical thinking, character and value development. The game for a plurality of participants comprises a playing surface having a plurality of playing regions. Each of the plurality of playing regions represents a different value category. The game also comprises a plurality of decks of playing cards. One side of each playing card in each deck displays a topic corresponding to a respective one of the value categories. The game further comprises a plurality of gamepieces, each assigned to one of the plurality of participants. Each of the gamepieces marks a playing position of the corresponding participant on the playing surface. In one embodiment, each surface of the dice has a color corresponding to the color of one of the decks of cards. During play, the selection of the deck from which a card is drawn is determined by the color of the surface of the dice that is cast. The participant then has a predetermined length of time to discuss or analyze the topic provided on the card. Value and character development of participants may be enhanced through the participation and guidance of a coordinator, parent or educator.

BRIEF DESCRIPTION OF THE DRAWINGS

The features and advantages of the present invention will become more readily apparent to those ordinarily skilled in the art after reviewing the following detailed description and accompanying drawings, wherein.

DETAILED DESCRIPTION OF THE INVENTION

Figure 1:
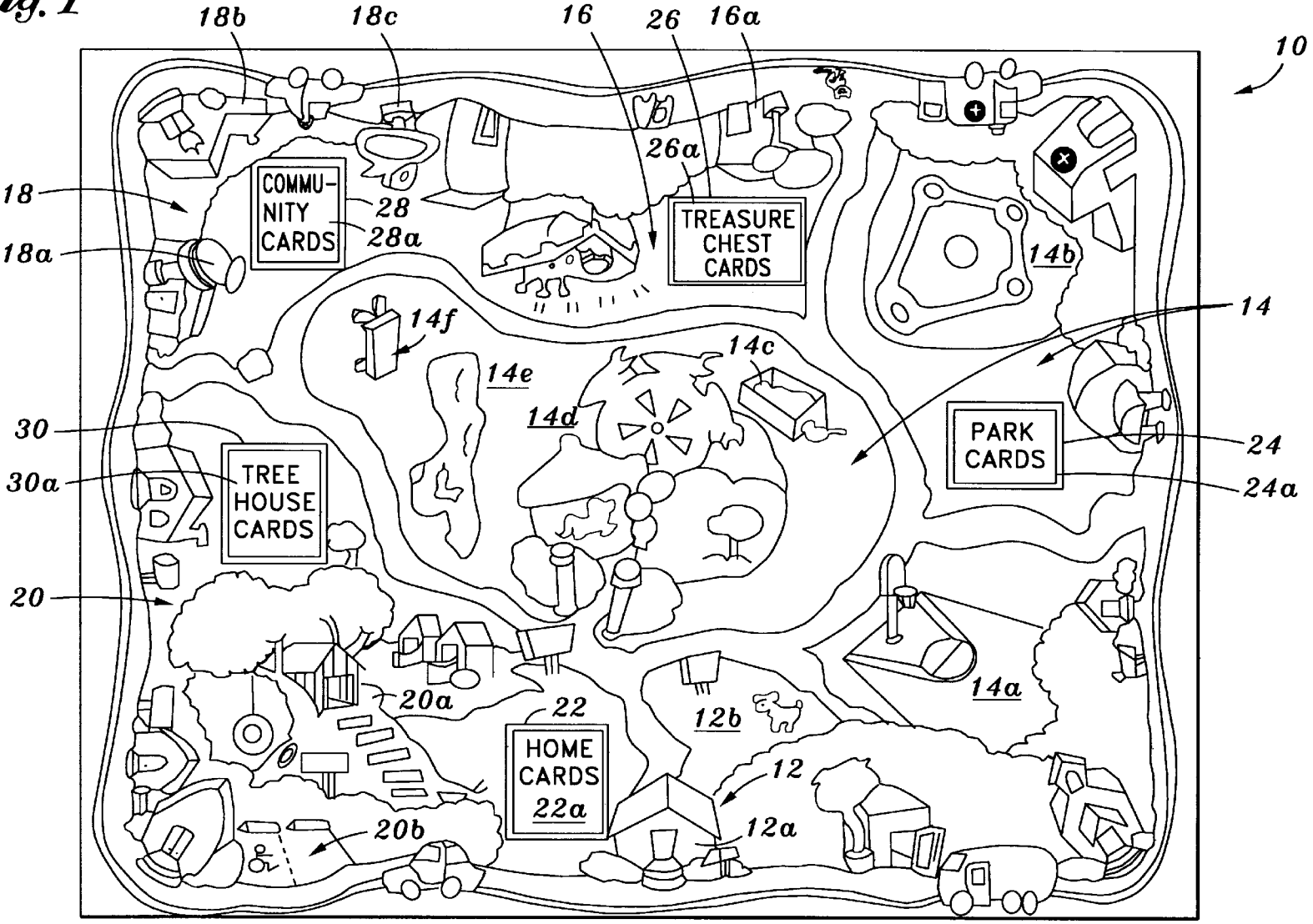
FIG. 1 is a top view of one embodiment or arrangement of a game board or playing surface for playing the game in accordance with the principles of the present invention.
Figure 2A:
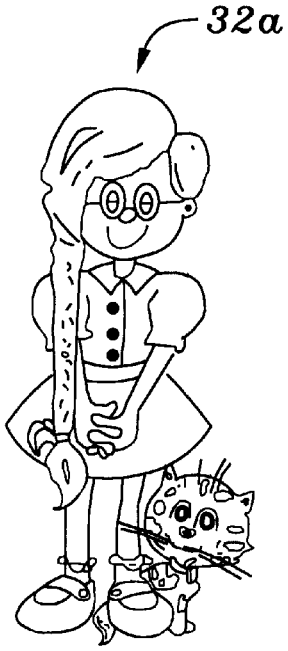
FIGS. 2A–J illustrate various embodiments of the gamepieces used in playing the game in accordance with the principles of the present invention.
Figure 2C:
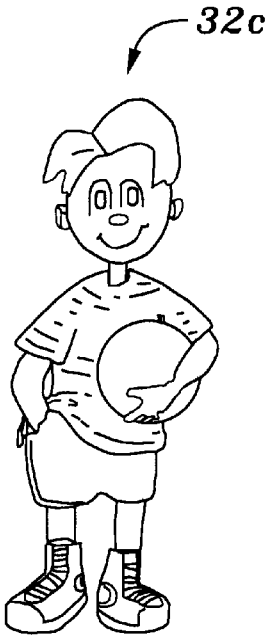
Figure 2E:
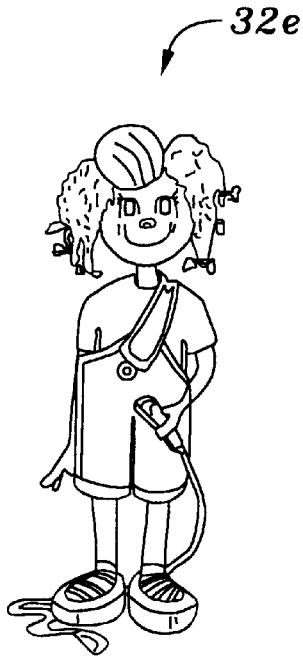
Figure 2B:
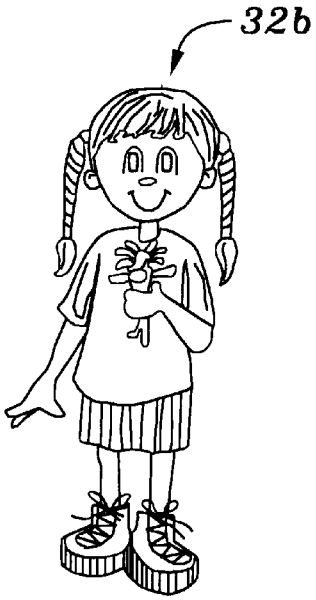
Figure 2D:
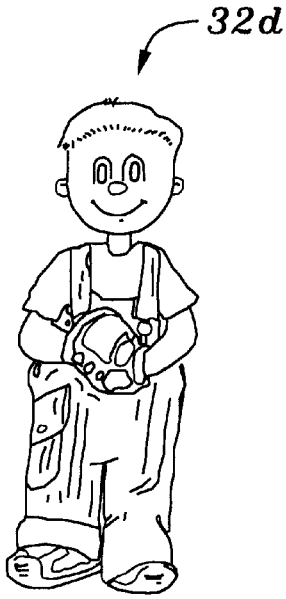
Figure 2F:
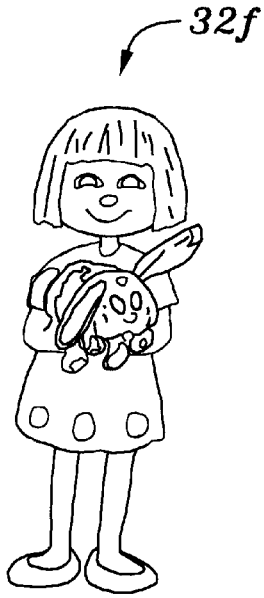
Figure 2G:
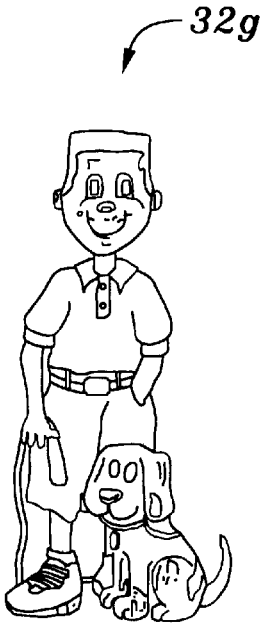
Figure 2I:
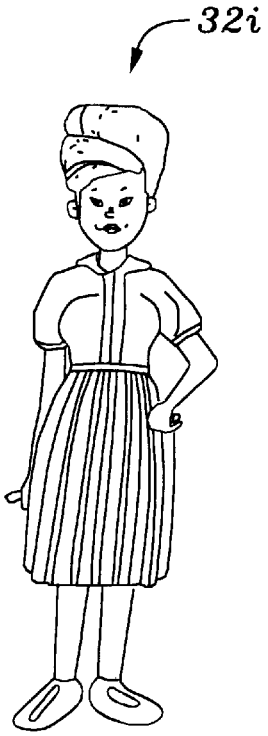
Figure 2H:
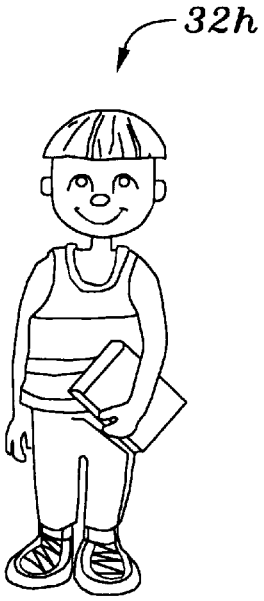
Figure 2J:
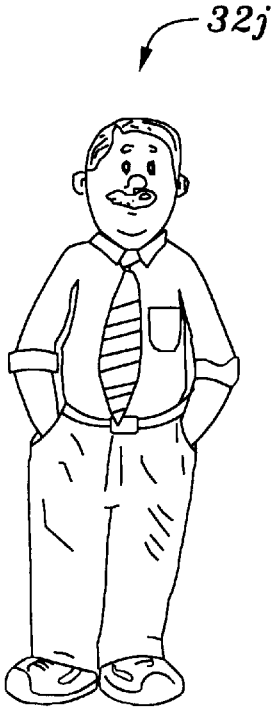

FIG. 1 is a top view of one embodiment or arrangement of the game board or playing surface for playing the game in accordance with the principles of the present invention. The game board 10 is preferably divided into five playing regions, namely, a Home Region 12, a Park Region 14, a Treasure Chest Region 16, a Community Area Region 18 and a Tree-House Region 20. The five regions 12–20 may be further subdivided into various locations. In one embodiment, the Home Region is divided into a house 12*a* and a backyard 12*b*; the Park Region 14 is divided into a basketball court 14*a*, a baseball diamond 14*b*, a sandbox 14*c*, a playground 14*d*, a pond 14*e* and a picnic area 14*f*; the Community Region 28 is divided into a fast food restaurant 18*a*, a police station 18*b* and a theater 18*c*; and the Tree-House Region may be divided into a main tree-house 20*a* and a parking lot 20*b*. It is understood that each playing region 12–20 may be divided into fewer or a greater number of locations.

Also located on the game board 10 are a plurality of playing spaces 22, 24, 26, 28 and 30 in which a corresponding deck of cards 22*a*, 24*a*, 26*a*, 28*a* and 30*a*, respectively, is placed, face down. The playing spaces 22, 24, 26, 28 and 30 and their corresponding deck of cards 22*a*, 24*a*, 26*a*, 28*a* and 30*a* respectively, correspond to each of the five playing regions 12, 14, 16, 18 and 20. In one embodiment, each deck of cards 22*a*, 24*a*, 26*a*, 28*a* and 30*a* comprises fifty cards.

For example, a deck of home cards 22*a* will be placed in the space 22, which is located in the Home Region 12; a deck of park cards 24*a* will be placed in the park space 24, which is located in the Park Region 14; a deck of treasure chest cards 26*a* will be placed in the treasure chest space 26, which is located in the Treasure Chest Region 16; a deck of community cards 28*a* will be placed in the community space 28, which is located in the community region 18; and a deck of tree-house cards 30*a* will be placed in the Tree-House Region 30, which is located in the Tree-House Region.

In one embodiment, each deck of cards 22*a*, 24*a*, 26*a*, 28*a* and 30*a* is of the same color as the corresponding playing space 22, 24, 26, 28 and 30. Such a color-coordinating scheme facilitates playing of the game by younger participants. Each deck of cards 22*a*, 24*a*, 26*a*, 28*a* and 30*a*, placed in the respective playing space 22, 24, 26, 28 and 30, include instructions for the player to move to a particular location such as any one of locations 12*a*, 12*b*, 14*a*, 14*b*, 14*c*, 14*d*, 14*e*, 14*f*, 16, 18*a*, 18*b*, 18*c* or 20*b*.

Each deck of cards 22*a*, 24*a*, 26*a*, 28*a* and 30*a* further includes text describing a scenario or problem directed towards critical thinking or analysis, character and/or value development, which requires the player to review and to provide a solution. In one embodiment, the topics listed on the deck of cards 22*a*, 24*a*, 26*a*, 28*a* and 30*a* correspond to scenarios directed towards family values (for cards placed in the home space 22); the development of social skills with peers (for cards placed in the park space 24); values directed at self discovery or the goals and perceptions of the player (for cards placed in the treasure chest space 26); development of social skills within the community (i.e., with persons other than peers) (for cards placed in the community space 28); and the development of friendship skills (for cards placed in the tree-house space 30).

Further examples of the topics provided on the cards 22*a*, 24*a*, 26*a*, 28*a* and 30*a* will now be described. The cards in the deck 22*a* associated with the Home Region 12 may pose a question or recite a scenario which facilitates the development of family values, including parental expectations, the responsibilities of children or other members of a family, respect, trust and limits directed to various types of behavior such as spending. Each card in the deck 22*a* may include a question or recite a scenario pertaining to any one of the above-described values.

The cards in the deck 24*a* associated with the Park Region 14 may pose a question or recite a scenario which the participant may encounter when they are out at play, or a social situation which involves his/her peer group. The cards in the deck 24*a* may also present a question or recite a scenario which facilitates the development of values such as honesty, loyalty and perseverance. Each card in the deck 24*a* may include a question or recite a scenario pertaining to any one of the above-described values.

The cards in the deck 26*a* associated with the Treasure Chest Region 16 may pose a question or recite a scenario which facilitates self-discovery (or self-analysis) for the participant or which enables the other players to become better acquainted with the dreams, goals and/or perceptions of the player. The cards in the deck 26*a* may also present a question or recite a scenario which facilitates the development of values such as positive mental attitude. In addition, topic on the cards 26*a* may present the opportunity for the educator, coordinator or parent to provide or shared role model values and skills. Each card in the deck 26*a* may include a question or recite a scenario pertaining to any one of the above-described values.

The cards in the deck 28*a* associated with the Community Region 18 may pose a question or recite a scenario which the participant may encounter when involved with activities in his/her community or immediate neighborhood. The scenario typically includes social situations that are outside of the participant's peer group. The scenario may also include situations that present as opportunity for the participant to develop greater cultural awareness and acceptance, understanding for others from a different religious or socio-economical background, citizenship, integrity and cooperation. In addition, various skills involving prevention and safety may be enhanced and/or developed. These include: gang and/or graffiti prevention; drug, tobacco or alcohol prevention; prevention of mental, physical or sexual abuse; safety issues involving weapons; and safety from strangers. Each card in the deck 28*a* may include a question or recite a scenario pertaining to any one of the above-described values.

The cards in the deck 30*a* associated with the Tree-House Region 20 may pose a question or recite a scenario that facilitates the development of initiative, compassion, understanding and friendship skills. In discussing the answers and/or solutions to the questions or scenarios posed, one of the participants, such as a coordinator, a parent or an educator, may assist younger participants in making good decisions or in developing values that are aligned with those of the coordinator, the parent or the educator. In addition, the critical thinking/analysis skills and conflict resolution skills of the younger participants may be encourage and/or enhanced. If the answer that the younger participant has provided is not acceptable, the coordinator, the parent or educator may provide guidance in exploring other options that are more acceptable. Each card in the deck 30*a* may include a question or recite a scenario pertaining to any one of the above-described values.

In one embodiment, optional cards bearing the statement "YOU'VE BEEN CAUGHT!" may be included in any one of the decks 22*a*–30*a*. These cards recite various scenarios directed at injecting additional excitement in the form of penalties, into the game. In a preferred embodiment, the penalties will take the form of an amusing or silly task, such as requiring the bearer of the card to close his/her eyes and touch his/her nose three times. In another embodiment, an optional sixth deck of cards, known as a "value" deck, may be used to facilitate playing of the game with the objective of winning. The values deck includes a recitation such as "You have won a value card!" and the cards in the deck may be divided and interspersed among the five other decks 22*a*–30*a*. Players may collect the "value" cards as they proceed through the game, and the person with the greatest number of "value" cards at the end of the game may be declared the winner. In a further embodiment, a number of "PASS" cards may be distributed to each participant, prior to commencement of the game. Use of a "PASS" card enables sensitive participants or participants dealing with sensitive issues to pass on answering a question. For example, each participant may be provided with two "PASS" cards with which they may exercise the option of not answering particular questions. It is understood that fewer or a greater number of "PASS" cards may be distributed to each participant.

Table 1 illustrates exemplary scenarios or problems that may be presented on the cards in the various decks. In addition, a number of blank cards may be provided for the participants to design scenarios or problems which pertain to the participants' special needs.

TABLE 1

| PLAYING REGIONS | SCENARIOS/RECITATIONS |
|---|---|
| Home Cards 22a | Location: Home<br><br>Your parents work very hard. They don't have extra money to buy you nice clothes. You feel guilty and embarrassed because some kids in school are teasing you. You know that your family can't afford new clothes for you . . . What can you do or say?<br>Location: Home<br><br>Your parents are out to dinner and your older brother is watching you. Your brother gets a phone call, hangs up and abruptly leaves the house. You are alone and scared. You don't know where he went or why . . . What do you do? |
| Park Cards 24a | Location: Park<br><br>A couple of kids are throwing some big rocks at the ducks in the pond at the park. They are laughing and being mean to the ducks, and you are upset by their actions . . . What can you do?<br>Location: Playground<br><br>You are at the park with Mom, and she is busy talking to the other mothers. You are being pulled off the swing by another kid, and you're yelling for "Mom," but she doesn't seem to hear you . . . What else can you do?<br>Location: On Bike Path in Park<br><br>Riding your bike through the park, you come upon a wallet on the bike path. You open the wallet and find lots of money . . . What would you do? |

TABLE 1-continued

| PLAYING REGIONS | SCENARIOS/RECITATIONS |
|---|---|
| | VALUE STATED PARENT REFERENCE STATED<br>Location: Basketball Court |
| | You are playing basketball with friends when a boy from one of your classes comes over and wants to join in the game. One kid objects to the boy joining the game because he is not the same color as the rest of the group . . . What do you say?<br>VALUE STATED PARENT REFERENCE STATED<br>Location: Playground |
| | The friend that is with you in the park wants you to deface some signs which he thinks would be fun. What do you say to him? |
| Treasure Chest Cards 26a | Location: Treasure Chest |
| | What is the nicest thing anyone has said about you?<br>Location: Treasure Chest |
| | What is something about you that no one would know just by looking at you?<br>Location: Treasure Chest |
| | If you had $1,000, how would you spend it?<br>Location: Treasure Chest |
| | Tell about your favorite T.V. program and explain why you like it.<br>Location: Treasure Chest |
| | Who has been you favorite teacher and WHY? |
| Community Cards 26a | Location: Community House of Worship |
| | Your community House of Worship is having a food drive for the needy. Why is it important for you to participate? Would you like to help deliver the food? Why?<br>Location: Playground |
| | You playing in the park with a friend when an older women approaches pulling a cart behind her. You don't know this women, and she starts asking you directions. What are you thinking about her? . . .<br>Location: Friend's House |
| | You are playing hide-and-seek at your friend's house. You hide in their parent's closet and see a hand gun in there. What do you do?<br>VALUE STATED PARENT REFERENCE STATED<br>Location: Scout Meeting at School |
| | Your scout troop has made "get well" cards for the community hospital. One of the kids in the troop doesn't want to go deliver them. You find out that his grandfather had died in that hospital a few week ago . . . What do you do?<br>VALUE STATED PARENT REFERENCE STATED<br>Location: Movie Theater |
| | Mom drops you off at the movie theater to meet some friends and see the latest adventure move. say you are buying your popcorn, you hear your friends talking about slipping into the "R-rate" movie instead of the one you came to see. What do you say to them? (You know you are not to go to "R" movies.)<br>Location: Classroom |
| | A new student joined your class this year. She uses a wheelchair to get around. Some of the kids are afraid of her, and some kids make fun of her . . . What do you think you would do? |
| Tree-House Cards 28a | Location: Tree-House |
| | One of your friends came to the tree-house and pulled out a can of beer from his/her jacket . . . He/she asks you to have a sip with him/her . . . You didn't expect your friend to ask you to drink . . . What do you say to him/her?<br>VALUE STATED PARENT REFERENCE STATED<br>Location: Tree-House |
| | Your best friend likes someone and asks you to tell him/her for her/him . . . What do you think about the request?<br>VALUE STATED PARENT REFERENCE STATED<br>Location: Tree-House |
| | One of your neighborhood friends is moving away with their mother because of a divorce. What could you do to make your friend feel better about the move? |
| Miscellaneous Cards (Optional) | *** You've been caught! ***<br>Penalty: |
| | Close your eyes and touch your nose with your fingers three times. |
| "Value" Cards (Optional) | ***YOU HAVE WON A VALUE***<br>(Value stated and explanation given with axioms around the boarder of the card) |
| Pass Cards (Optional) | ***YOU HAVE THE OPTION OF PASSING ON ANSWERING THE QUESTION*** |

Figure 3:
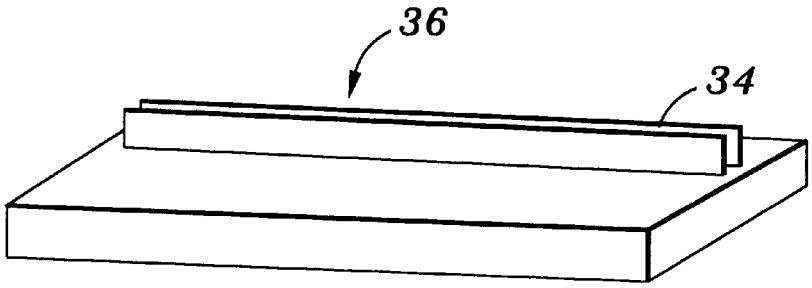
FIG. 3 illustrates one embodiment of a stand for holding each of the gamepieces shown in FIGS. 2A–J.

To play the game, each participant selects a gamepiece 32 or character such as any one of the gamepieces 32*a–j* shown in FIGS. 2A–J, respectively. The gamepieces 32*a–h* shown in FIGS. 2A–H respectively, represent children of various ages, racial groups and of either genders. The gamepieces 32*i–j* shown in FIGS. 2A–J respectively illustrate a female and a male adult. For present purposes, any one of the gamepieces will be referred to as the gamepiece 32. The participant may select a gamepiece 32 that resembles himself/herself or one whose role he or she would like to assume. In one embodiment, a gamepiece 32 may be provided which permits the participant to fill in the features or skin tone of a character he or she would like to assume, or which looks like himself or herself. It is apparent to one of ordinary skill in the art that gamepieces representing a person of any age group, such as children, youths, adults or senior citizens, of any ethnicity, nationality, or socio-economic background may be represented using the gamepiece 32. In one embodiment, the gamepieces 32 are made of a thin, plastic-coated material, such as a card board, which may be inserted into a slot 34 of a stand 36, such as that shown in FIG. 3.

Figure 4:
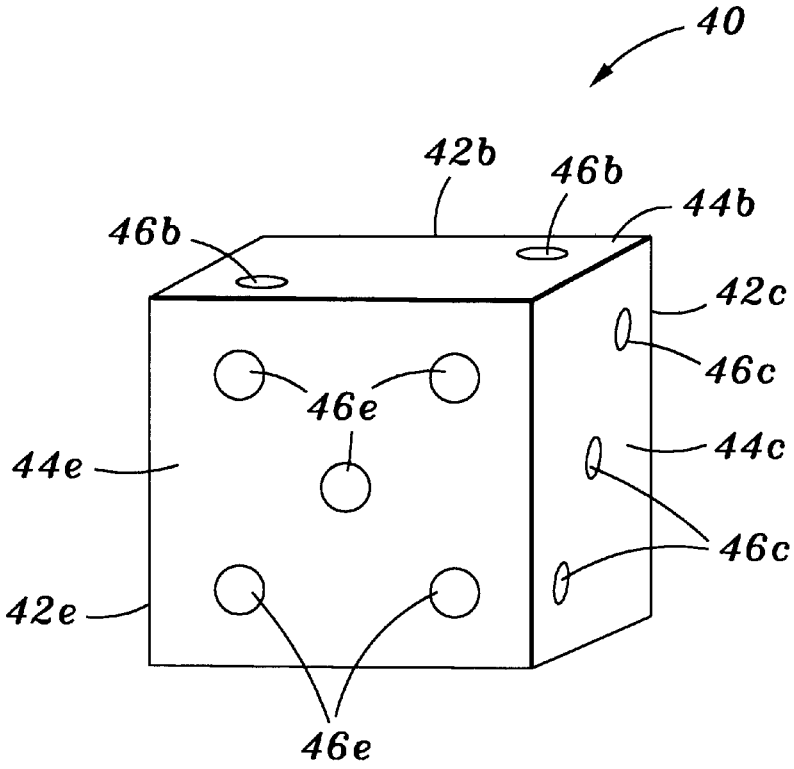
FIG. 4 illustrates one embodiment of a dice used in playing the game in accordance with the principles of the present invention.

The selected gamepieces 32, each representing a participant or player, are placed in the starting region, which is the Home Region 12. Prior to commencement of the game, the length of play and the number of players are determined. The length of play may be selected and determined by the ages of the participants and the number of participants. In one embodiment, it takes approximately 40–45 minutes for 2 players to each answer 6 questions. Once the length of play is determined, each player rolls a dice once, and the player with the highest number goes first, and turns are taken in a clockwise direction. In one embodiment, a color-coded dice 40, as shown in FIG. 4 is utilized. The color-coded dice has six surfaces 42*a–f* (only 42*b, c* and *e* are shown in FIG. 4), where the first to the fifth surfaces 42*a–e* each has a different color background 44*a–e* (only 44*b, c* and *e* are shown in FIG. 4). Each of the first to the fifth surfaces 42*a–e* also has one, two, three, four or five darkened circles 46*a–e* (only darkened circles 46*b, c* and *e* are shown in FIG. 4), respectively, which are of a different color from the backgrounds 44*a–e*. The sixth surface 42*f* of the dice 40 is blank, and if cast, indicates that the participant has to roll the dice 40 again. In one embodiment, the background 44*f* of the sixth surface 42*f* has a different color from the backgrounds 44*a–e* of the other surfaces 42*a–e*. In an alternate embodiment, the player who rolls a predetermined color may proceed first. The color-coded dice 40 facilitates playing of the game by younger participants. It is apparent to one of ordinary skill that various other methods of proceeding with the game may be utilized.

Figures 5, 6:
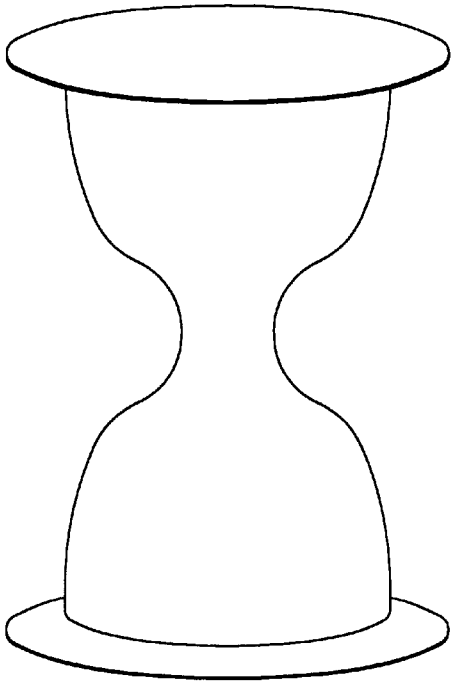
FIG. 5 illustrates one embodiment of a playing card which has thereon a topic corresponding to character and/or value development in accordance with the principles of the present invention.
FIG. 6 illustrates one embodiment of a timer used in playing the game in accordance to the principles of the present invention.

When the starting positions of the players have been determined, the first player rolls the dice 40 and proceeds to the select a card from the deck of cards 22*a*, 24*a*, 26*a*, 28*a* or 30*a* which has the same color as that indicated on the surface 42*a–f* of the dice 40 that is cast. The player reads the card's directions and moves his or her gamepiece 32 to the location or playing region 12, 14, 16, 18 or 20 indicated. FIG. 5 illustrates an exemplary card 50 which may be selected from the deck 22*a*. Table 1 illustrates further examples of the topics corresponding to critical thinking or analysis, character and/or value development that may be displayed on the card in each deck 22*a*, 24*a*, 26*a*, 28*a* or 30*a*. It should be noted that the locations specified on the card 50 corresponding to a particular region, for example, the Community Region 18, may also extend to locations in other regions 12, 14, 16 or 20. For example, as shown in Table 1, the directions on a card in the community deck 26*a* may require the participant to move to a location (e.g. playground) in the Park Region 14. As soon as the player finishes reading the card, he/she turns a timer 60, such as that shown in FIG. 6, upside down. The player then has a predetermined amount of time to think about the scenario and/or problem, and to give his/her solution or answer. In one embodiment, the predetermined amount of time is 3 minutes. It is apparent to one of ordinary skill in the art that any appropriate period of time may be used.

Once the response is completed by the first player, the card is placed at the bottom of the originating deck and the game proceeds to the next participant. As each card is drawn, the player moves his/her gamepiece 32 to the location indicated on the card and remains there until his/her next turn. In one embodiment, two gamepieces may occupy the same space or region 12–20. This arrangement avoids repetition and/or confusion. It is also apparent to one of ordinary skill in the art that fewer or a greater number of gamepieces may occupy the same space or region 12–20. The game continues until the predetermined length of time for playing has been reached or exceeded. The length of time for playing the game may, however, be extended according to the general consent of the participants or according to the direction of the coordinator, parent or educator.

Through participation in the game of the present invention, a participant's critical thinking or analysis, character and values may be enhanced and/or developed. In particular, a parent or educator may assist and guide children in making good value-based decisions, or with developing values that are aligned with those of the parent or the educator. As a result, children may learn to develop strong social skills (including conflict resolution skills) family values, compassion and self esteem. Adolescents may also develop conflict resolution skills and learn to cope with problems through the guidance of a peer counselor and develop strong social skills and values while learning to overcome difficult social or personal problems. Moreover, the participation in the game of the present invention may be extended to adults, who can use the game as a tool for resolving interpersonal, intrapersonal, and/or social problems, or to develop conflict resolution skills. The game of the present invention may also be used across all age groups to promote cultural awareness and to foster greater understanding among people from diverse backgrounds.

The present invention may be embodied in other specific forms without departing from its spirit or essential characteristics. For example, the game of the present invention may be provided electronically, as a computer game in the form of CD Roms or a video game. The described embodiments are to be considered in all respects only as illustrative and not restrictive. The scope of the invention is, therefore, indicated by the appended claims rather than the foregoing description. All changes which come within the meaning and range of equivalency of the claims are to be embraced within their scope.

What is claimed is:

1. A game for K participants designed to provide value development, comprising:

a playing surface having N distinct and non-repetitive playing regions, each of said N distinct and non-repetitive playing regions representing a different value category, each of said playing regions being divided into distinct locations;

N distinct and non-repetitive playing spaces corresponding to the N distinct and non-repetitive playing regions, the N playing spaces being adjacent to the corresponding N playing regions;

N distinct and non-repetitive decks of playing cards corresponding to said N distinct playing spaces, each deck of cards having a different predetermined color, the N decks of cards being placed on the corresponding N playing spaces, each of said deck of playing cards having a first indicia corresponding to the respective playing regions and value category represented by the corresponding playing space on which said each of said deck is placed, each of said playing cards also having a second indicia corresponding to a respective location, at least one of said playing cards having a second indicia corresponding to a location not located in the playing region corresponding to said card, one side of each card in each deck of playing cards having thereon a topic corresponding to a respective one of said value categories; and at least K gamepieces, each assigned to one of K participants, each of said gamepieces marking a playing position of the corresponding participant on said playing surface.

2. The game as provided in claim 1, wherein each of said value category is a value-based character development category.

3. The game as provided in claim 1, wherein said N distinct and non-repetitive playing regions include at least one of a home region, a park region, a treasure chest region, a community area region and a tree-house region.

4. The game as provided in claim 3, wherein the value category corresponding to the home region comprises family values and responsibilities.

5. The game as provided in claim 3, wherein the value category corresponding to the park region comprises social values involving a peer group.

6. The game as provided in claim 3, wherein the value category corresponding to the treasure chest region comprises values directed at a perception of the participant.

7. The game as provided in claim 3, wherein the value category corresponding to the community area region comprises values associated with a community.

8. The game as provided in claim 3, wherein the value category corresponding to the tree-house region comprises values associated with the development of compassion and friendship skills.

9. The game as provided in claim 1, further including a select element having N+1 surfaces, each of the surfaces having an indicia representative of a number, the select element being used to determine the order of placing each of said gamepieces on said playing surface, the (N+1)th surface having an indicia representative of a request to recast the select element.

10. The game as provided in claim 9, wherein each deck of cards has a different, predetermined color and each surface of said select element has a background color, and the background color of each surface corresponds to the predetermined color of each deck; wherein the background color of each surface of said select element is representative of the deck from which a card is selected.

11. The game as provided in claim 1, further comprising a timer for determining a length of time for discussing the topic.

12. The game as provided in claim 1, wherein the at least K gamepieces are at least K characters representative of at least K different ethnic groups.

13. The game as provided in claim 1, wherein the at least K gamepieces are at least K characters representative of at least K different age groups.

14. A method of playing a game designed to provide value development, comprising:

(a) providing a playing surface having N distinct and non-repetitive playing regions, each of said N distinct and non-repetitive playing regions representing a different value category, each of said playing regions being divided into distinct locations;

(b) providing N distinct and non-repetitive playing spaces, the N playing spaces corresponding to and being adjacent to the N playing regions;

(c) providing N distinct and non-repetitive decks of playing cards corresponding to said N distinct playing spaces, placing N distinct and non-repetitive decks of playing cards corresponding to said N distinct playing spaces on the corresponding N playing spaces, each deck of cards having a different predetermined color, each of said deck of playing cards having a first indicia corresponding to the respective playing regions and value category represented by the corresponding playing space on which said each of said deck is placed, each of said playing cards also having a second indicia corresponding to a respective location, at least one of said playing cards having a second indicia corresponding to a location not located in the playing region corresponding to said card, one side of each deck of playing cards having thereon a topic corresponding to a respective one of said value categories;

(d) selecting a card from one of said decks of playing cards; and (e) discussing an answer to the topic provided on the selected card.

15. The method as provided in claim 14, wherein in step (a), said N distinct and non-repetitive playing regions include at least one of a home region, a park region, a treasure chest region, a community area region and a tree-house region.

16. The method as provided in claim 15, wherein in step (a), the value category corresponding to the home region comprises family values and responsibilities.

17. The method as provided in claim 15, wherein in step (a), the value category corresponding to the park region comprises social values involving a peer group.

18. The method as provided in claim 15, wherein in step (a), the value category corresponding to the treasure chest region comprises values directed at a perception of the participant.

19. The method as provided in claim 15, wherein in step (a), the value category corresponding to the community area region comprises values associated with a community.

20. The method as provided in claim 15, wherein in step (a), the value category corresponding to the tree-house region comprises values associated with the development of compassion and friendship skills.

21. The method as provided in claim 14, prior to step (a), further comprising the steps of:

providing a select element having N+1 surfaces, each of the N surfaces having an indicia representative of a number, the (N+1)th surface having an indicia representative of a request to recast the select element; and casting the select element to determine a starting position of a participant.

22. The method as provided in claim 21, wherein each surface of said select element has a background color, and wherein in step (b), each deck of cards has a different, predetermined color, and the background color of each surface corresponds to the predetermined color of each deck, wherein the method further comprises the step of:

selecting a card from the deck having a color that is the same as the background color of a surface of said select element that is cast.

23. A game for K participants designed to provide development of critical thinking, comprising:

a playing surface having N distinct and non-repetitive playing regions, each of said N distinct and non-repetitive playing regions representing a different analytical category, each of said playing regions being divided into distinct locations;

N distinct and non-repetitive playing spaces corresponding to the N distinct and non-repetitive playing regions, the N playing spaces being adjacent to the corresponding N playing regions;

N distinct and non-repetitive decks of playing cards corresponding to said N distinct playing spaces, each deck of cards having a different predetermined color, the N decks of cards being placed on the corresponding N playing spaces, each of said deck of playing cards having a first indicia corresponding to the respective playing regions and analytical category represented by the corresponding playing space on which said each of said deck is placed, each of said playing cards also having a second indicia corresponding to a respective location, at least one of said playing cards having a second indicia corresponding to a location not located in the playing region corresponding to said card, one side of each card in each deck of playing cards having thereon a topic corresponding to a respective one of said analytical categories; and at least K gamepieces, each assigned to one of K participants, each of said gamepieces marking a playing position of the corresponding participant on said playing surface.

24. The game as provided in claim 23, wherein said N distinct and non-repetitive playing regions include at least one of a home region, a park region, a treasure chest region, a community area region and a tree-house region.

25. The game as provided in claim 23, wherein the analytical categories include at least one of cultural awareness, self-analysis, and conflict resolution.

26. The game as provided in claim 23, further comprising a select element having (N+1) surfaces, each of the surfaces having an indicia representative of a number, the select element being used to determine the order of placing each of said gamepieces on said playing surface.

* * * * *